United States Patent [19]

Thompson

[11] 3,986,221

[45] Oct. 19, 1976

[54] BOOT TREE

[76] Inventor: Otto D. Thompson, 8472 Mariners Cove Drive, Huntington Beach, Calif. 92646

[22] Filed: Feb. 13, 1976

[21] Appl. No.: 658,256

[52] U.S. Cl. ..... 12/114.8
[51] Int. Cl.[2] ..... A43D 5/00
[58] Field of Search ..... 12/114.8, 117.4

[56] References Cited

UNITED STATES PATENTS

| | | | |
|---|---|---|---|
| 1,650,846 | 11/1929 | Moland | 12/114.8 |
| 2,253,725 | 8/1941 | Plotkin | 12/114.8 |
| 3,187,357 | 6/1965 | McCabe | 12/114.8 |

*Primary Examiner*—Patrick D. Lawson
*Attorney, Agent, or Firm*—Philip M. Hinderstein

[57] ABSTRACT

A boot tree comprising a shoe tree including adjustably interconnected toe and heel structures, an elongate shaft including adjustably interconnected shaft sections and having a plurality of longitudinally spaced, laterally oriented grooves in the outer surface thereof, one end of the shaft being pivotably connected to the shoe tree, a handle connected to the other end of the shaft, a crossbar pivotably connected to the shaft, a pair of boot strap engaging hook members connected to the opposite extremities of the crossbar, and a locking tongue connected to the crossbar and engaging one of the grooves in the shaft in one angular position of the shaft relative to the crossbar so as to permit movement of the crossbar towards the handle and to prevent movement of the crossbar towards the shoe tree, rotation of the handle and the shaft relative to the crossbar and the shoe tree from the one position releasing the locking tongue and permitting movement of the crossbar towards the shoe tree and release of the hook members from the boot straps.

4 Claims, 4 Drawing Figures

BOOT TREE

BACKGROUND OF THE INVENTION

1. Field of the Invention

The present invention relates to a boot tree and, more particularly, to a boot tree adapted to be positioned in a riding boot or the like for supporting and stretching the same when not in use.

2. Description of the Prior Art

It is well known to users of riding boots and the like that the same become damp in use, principally from perspiration. If the boots are stored without a supporting structure when not in use, they will quickly loose their shape and become wrinkled, undressy, and uncomfortable, this especially being the case in the better class of boots which are made of a thinner and more expensive grade of leather.

For the above and other reasons, a variety of boot trees have been developed for supporting and stretching a boot when not in use whereby the shape of the boot will be maintained and its appearance enhanced during the life thereof. A typical boot tree includes, in addition to toe and heel engaging sections for preserving the shape of the foot portion of the boot, means engagable with the boot straps to which manual traction may be applied to straighten the leg portion of the boot, thus preventing wrinkling at the ankle portion thereof and sagging of the boot in general. Typical prior art boot trees are shown in U.S. Pat. Nos. 151,701; 1,650,846; 1,862,168; 1,978,496; 2,025,173; and 3,187,357.

While a number of boot trees have been proposed, as exemplified by those shown in the above-listed patents, a number of problems exist therewith. Prior devices are typically complex and expensive and are therefore inappropriate for wide-spread use. Many of the prior boot trees are adaptable only to the particular boots for which they are specifically made and afford no appreciable amount of ventilation in the interior of the boot so that when the boots are damp or wet, drying takes place very slowly. Still further, many prior boot trees may be operated only from inside of the boot so that considerable difficulty has been experienced in the detachment of the boot tree from the boot straps.

SUMMARY OF THE INVENTION

According to the present invention, there is provided a boot tree which is simple, efficient, and relatively inexpensive and which may be quickly and easily inserted into and removed from a boot. When so inserted, the present boot tree will afford a maximum of ventilation in the interior thereof to permit rapid drying. The present boot tree is readily adjustable to various sizes of boots and when in use obviates the formation of uncomfortable and unsightly ankle wrinkles.

Briefly, the present boot tree comprises: a shoe tree including adjustable interconnected toe and heel structures; an elongate shaft including adjustably interconnected shaft sections and having a plurality of longitudinally spaced, laterally oriented grooves in the outer surface thereof, one end of the shaft being pivotably connected to the shoe tree; a handle connected to the other end of the shaft; a crossbar having a hole extending laterally therethrough, the shaft extending through the hole in the crossbar for pivotably mounting the crossbar on the shaft; a pair of boot strap engaging hook members connected to the opposite extremities of the crosssbar; and a spring metal locking tongue connected to one side of the crossbar and extending laterally, downwardly therefrom towards the shaft and into one of the grooves therein when the shaft is in one angular position relative to the crossbar, the locking tongue permitting movement of the crossbar towards the handle but preventing movement of the crossbar towards the shoe tree when the shaft is in the one position, rotation of the handle and the shaft relative to the crossbar from the one position releasing the locking tongue and permitting movement of the crossbar towards the shoe tree and release of the hook members from the boot straps.

OBJECTS

It is therefore an object of the present invention to provide a boot tree.

It is a further object of the present invention to provide a simple and inexpensive boot tree.

It is a still further object of the present invention to provide a boot tree which is adaptable to different sizes of boots.

It is another object of the present invention to provide a boot tree which permits maximum ventilation to the interior of a boot.

It is another object of the present invention to provide a boot tree which is readily attachable to and removable from a boot.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like parts in the several figures and wherein:

DESCRIPTION OF THE PREFERRED EMBODIMENT

Figure 1:
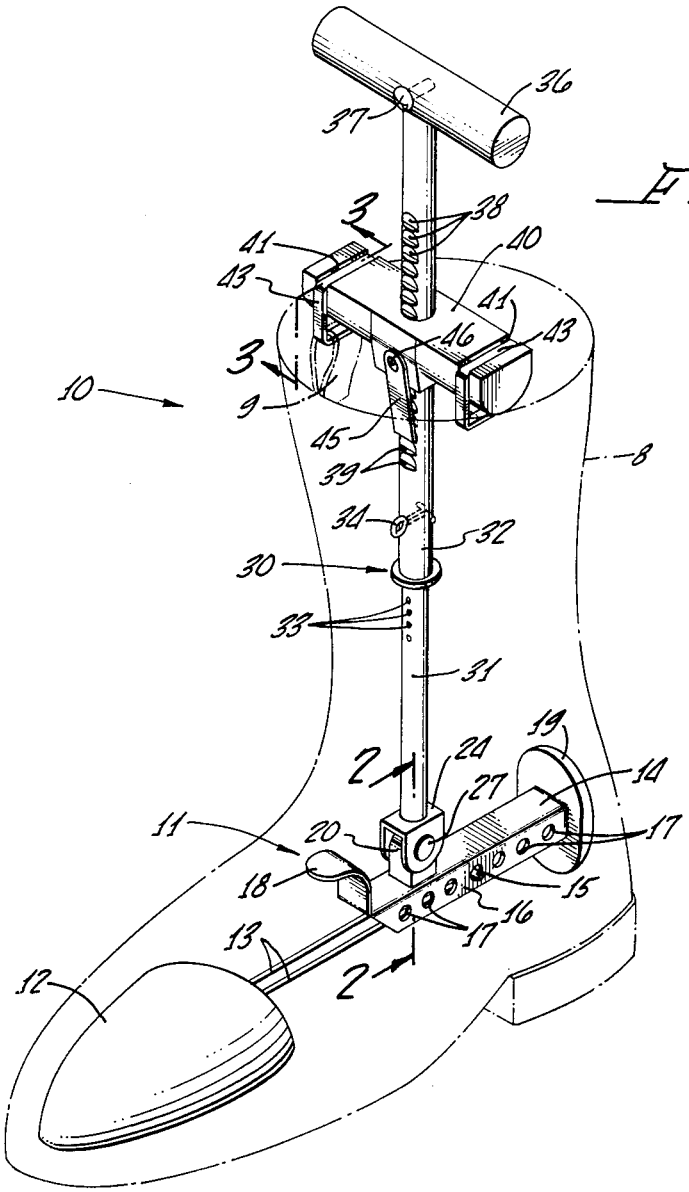
FIG. 1 is a perspective view of a boot tree constructed in accordance with the present invention shown in its locked position relative to a boot.
Figure 2:
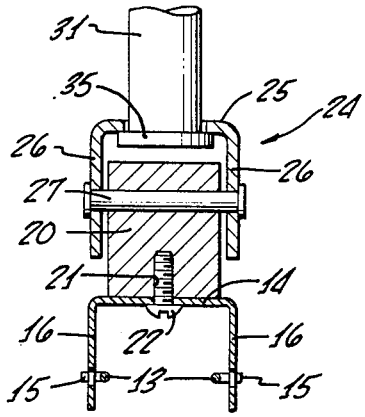
FIGS. 2 and 3 are enlarged sectional views taken along the lines 2—2 and 3—3, respectively, in FIG. 1.

Referring now to the drawings, the present boot tree, generally designated 10, comprises a shoe tree, generally designated 11, of conventional construction. More particularly, shoe tree 11 may include a shell-shaped toe structure 12 which is pivotably connected by a metal band (not shown) to a spring metal wire frame 13 which may be adjustably connected to a U-shaped heel structure 14. The free ends of wire frame 13 are outwardly turned, at 15, and being of springy material are adapted to be manually compressed towards each other so that the overall width of ends 15 may enter between the flanges 16 of U-shaped heel structure 14. On manual release of the sides of wire frame 13, ends 15 are adapted to extend into spaced apertures 17 arranged in flanges 16 of heel structure 14.

Heel structure 14 is provided with an outwardly turned tongue 18 at one end thereof and a heel bearing element 19 at the other end thereof. Accordingly, shoe tree 11 and, more particularly, toe structure 12, heel structure 14, and interconnecting wire frame 13, adjustably comprise a unit which may be made to accommodate different sizes of the foot portions of boots. As is known in the art, by elevating tongue 18, heel structure 14 pivots about ends 15 of wire frame 13, permitting insertion of shoe tree 11 into the foot portion of a shoe or boot. Upon depression of tongue 18, heel structure 14 is brought into the position shown in FIG. 1, locking shoe tree 11 in the foot portion of a shoe or boot.

According to the present invention, conventional shoe tree 11 is modified for use as a boot tree. More particularly, heel structure 14 has connected to the central portion thereof, adjacent tongue 18, a post 20. Post 20 has an internally threaded hole 21 in the lower surface thereof, the surface which rests on heel structure 14. Heel structure 14 may be provided with a matching hole through which may be extended a bolt 22 for engaging hole 21 in post 20 thereby rigidly connecting post 20 to heel structure 14. Boot tree 10 further comprises a channel 24 having a central portion 25 and side flanges 26. A rivet or nut and bolt combination 27 is adapted to extend laterally through mating holes in flanges 26 and post 20 to connect channel 24 to post 20 for pivotable movement around the axis of rivet 27. Central portion 25 also has a hole therethrough.

Boot tree 10 further comprises an elongate shaft 30 including adjustably interconnected shaft sections 31 and 32. Shaft section 31 is a solid member whereas shaft section 32 is a hollow member, shaft section 31 extending through shaft section 32 for axial movement relative thereto. Connection of shaft sections 31 and 32 may be achieved in any conventional manner such as by providing shaft 31 with a plurality of longitudinally spaced holes 33 and shaft 32 with a single hole and by extending a cotter pin 34 through the hole in shaft section 32 and one of the holes 33 in shaft section 31.

Shaft section 31 extends through the hole in central portion 25 of channel 24 and has an enlarged head 35 on the end thereof adjacent post 20 to prevent removal of shaft section 31 from channel 24. This also provides a pivotable connection between shaft section 31 and channel 24 to permit freedom of rotation of shaft 30 relative to shoe tree 11.

Boot tree 10 further comprises a handle 36 connected to the free end of shaft section 32, connection being made by passing a screw 37 laterally through handle 36 and into shaft section 32. Shaft section 32 also has a plurality of longitudinally spaced, laterally oriented, wedge-shaped grooves 38 in the outer surface thereof so as to provide a plurality of upwardly facing abutments 39.

Figure 3:
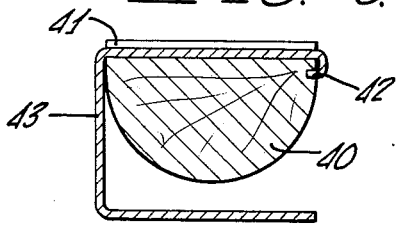
Figure 4:
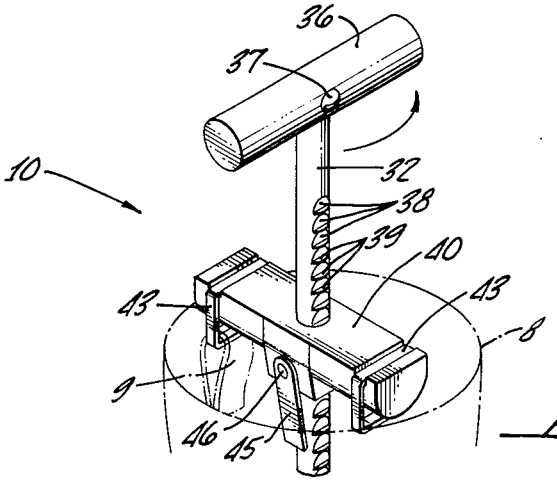
FIG. 4 is a perspective view of the upper portion of the boot tree and boot of FIG. 1, showing the manner of releasing the boot straps.

Pivotably connected to shaft section 32 of shaft 30 is a crossbar 40. As shown most clearly in FIGS. 1 and 3, crossbar 40 has a generally semi-circular cross section and has a central hole extending laterally therethrough, through which shaft section 32 extends, thereby permitting rotation of crossbar 40 relative to shaft section 32. The upper surface of crossbar 40 has a pair of grooves 41 therein, at the opposite ends thereof, and a pair of holes 42 in the rear surface thereof, directly below grooves 41. Grooves 41 and holes 42 are adapted for receipt of a pair of boot strap engaging hook members 43, first ends of which extend into holes 42 in crossbar 40. The remainder of hook members 43 extend upwardly along the back of crossbar 40, across the top of crossbar 40, through grooves 41 therein, downwardly past the front of crossbar 40, and then below the bottom of crossbar 40, spaced therefrom. Upon insertion into a boot 8, as shown in FIG. 1 and 4, these lower portions of hook members 43 are adapted to engage the boot straps 9 thereof.

Crossbar 40 supports one end of a spring metal locking tongue 45 which extends laterally downwardly therefrom towards grooves 38 in shaft section 32. Locking tongue 45 may be connected to crossbar 40 with a screw 46.

OPERATION

In operation, the holding of handle 36 automatically elevates tongue 18 of heel structure 14, causing downward pivoting of toe structure 12 and heel bearing element 19 about rivet 27. This permits the shoe tree portion 11 of boot tree 10 to be readily inserted into boot 8. After such insertion, by pushing downwardly on handle 36, shaft 30 moves tongue 18 down, locking heel bearing element 19 and toe structure 12 in the foot portion of boot 8.

In the positions of crossbar 40 and handle 36 shown in FIG. 1, crossbar 40 may be readily elevated by extending the fingers of one hand thereunder. Crossbar 40 may then be elevated until hook members 43 engage boot straps 9. Since abutments 39 face upwardly, locking tongue 45 permits movement of crossbar 40 towards handle 36 in these positions of handle 36 and crossbar 40. Upon continued upward movement of crossbar 40, a sufficient tension is applied to boot straps 9 to straighten out the wrinkles in boot 8. Furthermore, locking tongue 45 progressively engages abutments 39 in shaft section 32, preventing movement of crossbar 40 towards shoe tree 11 and locking boot tree 10 between the foot portion of boot 8 and boot straps 9.

When it is desired to release boot tree 10 to remove same from boot 8, it is simply necessary to grip handle 36 and to rotate it through an angle of approximately 90° to the position shown in FIG. 4. Shaft 30 readily rotates relative to crossbar 40 and shoe tree 11 because of the pivotable connection between shaft section 31 and channel 24. Furthermore, crossbar 40 is prevented from rotating with handle 36 and shaft 30 because of the engagement between hook members 43 and boot straps 9 of boot 8.

As will be evident from an inspection of FIGS. 1 and 4, as soon as handle 36 rotates shaft section 32 to the position shown in FIG. 4, locking tongue 45 is automatically disengaged from grooves 38. Thus, the tension applied to hook members 43 by boot straps 9 automatically pulls crossbar 40 downwardly, releaving the tension in boot 8 and permitting the disengagement of hook members 43 from boot straps 9. Once disengaged, elevation of handle 36 removes boot tree 10 from boot 8.

It can therefore be seen that according to the present invention, there is provided a boot tree 10 which is simple, efficient, and relatively inexpensive and which may be quickly and easily inserted into and removed from boot 8. When inserted, boot tree 10 will afford a maximum of ventilation in the interior of boot 8 to permit rapid drying thereof. Boot tree 10 is readily adjustable to various sizes of boots and when in use, obviates the formation of uncomfortable and unsightly ankle wrinkles.

While the invention has been described with respect to a preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. A boot tree comprising:

a shoe tree including adjustably interconnected toe and heel structures;

an elongate shaft including adjustably interconnected shaft sections and having a plurality of longitudinally spaced, laterally oriented grooves in the outer surface thereof, one end of said shaft being pivotably connected to said shoe tree;

a handle connected to the other end of said shaft;

a crossbar pivotably connected to said shaft;

a pair of boot strap engaging hook members connected to the opposite extremities of said crossbar; and a locking tongue connected to said crossbar and engaging one of said grooves in said shaft in one angular position of said shaft relative to said crossbar, said locking tongue permitting movement of said crossbar towards said handle and preventing movement of said crossbar towards said shoe tree with said shaft in said one position, rotation of said handle and said shaft relative to said crossbar and said shoe tree from said one position releasing said locking tongue and permitting movement of said crossbar towards said shoe tree and release of said hook members from said boot straps.

2. A boot tree according to claim 1 wherein said crossbar has a hole extending laterally therethrough, said shaft extending through said hole in said crossbar and wherein said locking tongue is connected to the side of said crossbar and extends laterally, downwardly therefrom towards said shaft and into one of said grooves therein when said shaft is in said one position.

3. A boot tree according to claim 2 wherein said grooves are wedge-shaped to provide a plurality of upwardly facing abutments, said abutments preventing movement of said crossbar towards said shoe tree with said shaft in said one position.

4. A boot tree according to claim 3 wherein said locking tongue is made from a spring metal and bears against said shaft.

* * * * *